US006807456B1

(12) United States Patent
Costin, Jr. et al.

(10) Patent No.: US 6,807,456 B1
(45) Date of Patent: Oct. 19, 2004

(54) FRACTAL JEAN MANUFACTURING

(75) Inventors: Darryl Costin, Jr., Westlake Village, OH (US); Darryl Costin, Sr., Westlake Village, OH (US)

(73) Assignee: Technolines, LLC, Westlake, OH (US)

( * ) Notice: Subject to any disclaimer, the term of this patent is extended or adjusted under 35 U.S.C. 154(b) by 116 days.

(21) Appl. No.: 09/683,711

(22) Filed: Feb. 5, 2002

Related U.S. Application Data

(60) Provisional application No. 60/267,619, filed on Feb. 9, 2001.

(51) Int. Cl.[7] ..... G06F 19/00; B23K 26/00

(52) U.S. Cl. ..... 700/132; 700/132; 700/134; 700/136; 219/121.61; 219/121.69; 8/115.52

(58) Field of Search ..... 700/134, 132, 700/131, 133, 136, 137, 138; 219/121.6, 121.61, 121.69, 121.68, 121.72, 121.78, 121.8; 8/444, 115.52; 223/1

(56) References Cited

U.S. PATENT DOCUMENTS

| | | | | | |
|---|---|---|---|---|---|
| 5,990,444 | A | * | 11/1999 | Costin | 219/121.69 |
| 6,002,099 | A | * | 12/1999 | Martin et al. | 219/121.69 |
| 6,090,158 | A | * | 7/2000 | McLaughlin | 8/115.52 X |
| 6,616,710 | B1 | * | 9/2003 | Costin et al. | 8/444 |

* cited by examiner

*Primary Examiner*—Peter Nerbun
(74) *Attorney, Agent, or Firm*—Scott C. Harris, Esq.

(57) ABSTRACT

Formation of fractal garments using a laser to scribe a total pattern onto jean parts. The pattern is formed into a 60 by 60 image, that is formed to form all parts of the denim design.

12 Claims, 7 Drawing Sheets

FRACTAL JEAN MANUFACTURING

CROSS REFERENCE TO RELATED APPLICATIONS

The present invention claims priority from No. 60/267,619, filed Feb. 9, 2001.

BACKGROUND OF INVENTION

There has been a large market demand for denim jeans with "worn looks" and other value-added designs. "Worn looks" are created on denim jeans with the sandblast process or hand-rubbing or machine rubbing process. The denim jean is sewn and processed with sandblasting or rubbing operations, and then washed. This becomes more difficult when it is desired to cover large areas of the jean. For example, if an applied graphic pattern were to cover the entire jean, it might miss several noticeable areas on the jean and appear undesirable. If one were to attempt to form the designs on a finished garment, areas under the belt loops, inside the four pockets, inside the waistband, underneath the crotch area and underneath the fly could not get processed in finished or sewn form. Also, since it is extremely difficult to expand the jean to lie completely flat, wrinkles and areas below the rear might not be completely processed.

Other designs can be placed on denim rolls in the textile mills by discharge printing or other in-line processes. However, this process may create significant waste since the denim panels (which make up a pair of jeans) are cut from a denim textile roll in patterns. The waste denim scraps are discarded. Furthermore, if the graphic patterns are to be located in specific sections of the denim jean, it becomes difficult to cut the denim roll to the exact specifications. Therefore, only, patterns which are repeatable can be applied in this process.

Technolines , LLC is the assignee of several patents and patent applications for using lasers to process materials to change the look of those materials. One of these applications describes the production of fractal jeans—jeans imprinted with graphic patterns along the entire fabric area with a laser.

SUMMARY OF INVENTION

The present application describes lazing the patterns, e.g. fractal patterns on denim panels. The lazing may be carried out after the denim panels are cut from the textile roll and before they are sewn in finished form. Another technique involves lazing on a 60×60 inch piece of denim and cutting it into denim panels afterwards. However, this would require exact placement and accuracy when cutting the denim. Both concepts address applying the graphic pattern to every square inch of the denim jeans, such that after they are sewn, the graphic pattern is present inside the waistband, pockets and belt loops as well as visible in all the other areas of the jean. Further, for the initial technique, only the actual denim used in the sewing of the jean may be printed, and not unused denim from the textile roll. This technique allows placement of specific graphics on individual sections of the denim jean (back pockets, thigh area, waistband, riser, rear section, etc).

BRIEF DESCRIPTION OF DRAWINGS

These and other aspects will now be described in detail with reference to the accompanying drawings, in which.

DETAILED DESCRIPTION

Figure 1A:
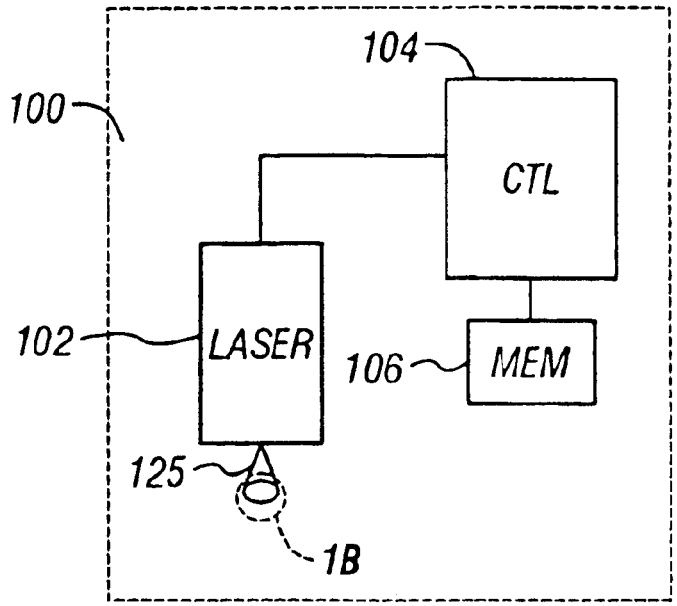
FIG. 1A shows a basic block diagram of a laser formation system according to the present invention.

The basic layout is shown in FIG. 1A. A controlled laser system 100 includes a laser 102 and a controller 104. The controller 104 causes the laser to produce patterns based on information in the memory 106. The output of the laser produces output patterns are formed at an energy density per unit time which will cause a noticeable change in the material being processed (here denim), but will not undesirably mark or burn through the denim, unless it is intentionally desired to do so. The concepts of the application of power by this laser system are described in U.S. Pat. No. 5,990,444.

Figure 1B:
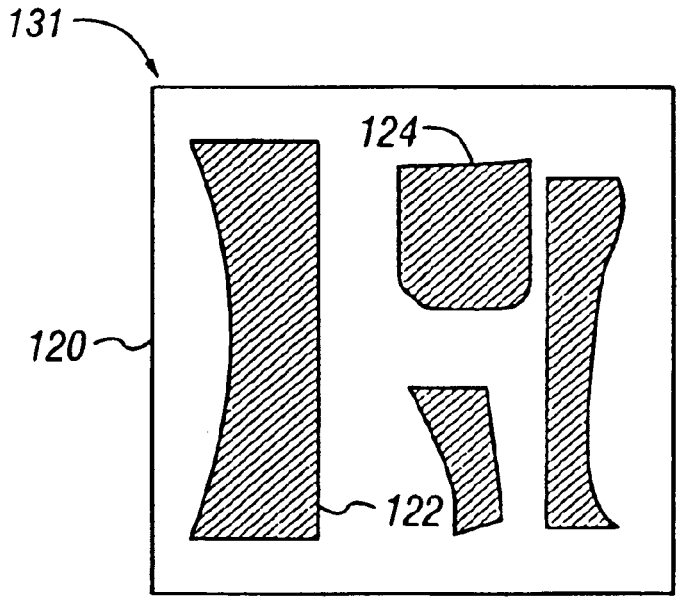
FIG. 1B shows a closeup of a multiple panel system.

Here, the controller 104 is programmed to produce special patterns on fabric sizes of individual jean panels, as shown in FIG. 1B. A denim roll will be cut into individual parts that make up an entire jean. For most pairs of jeans, the individual denim panels which make up the pair of jeans could be fit inside a 60 inch square area. In this embodiment, all of the panels for a specific pair of jeans are lazed in a single lazing operation. FIG. 1B shows a 60 by 60 inch material panel 120 which includes the sections such as 122, 124 that will eventually form the finished garment in a way such that the pattern is formed. In this embodiment, the 60 by 60 panel is lazed and cut to form the garment. Alternatively, the sections 122 can be cut in advance and individually. In certain kinds of operations, such as formation of regular patterns which may overlap, the entire 60 by 60 panel may be lazed as a single piece.

Typical high-powered lasers driven by galvo systems have field sizes ranging from a few inches to 18 inches. However, by changing the optics 125 and moving the focal point to a location 131, about 80 inches from 10–40 inches (depending upon optics), a laser system driven by galvo mirrors with a field size of 60 by 60 inches or greater may be obtained.

Figure 2:
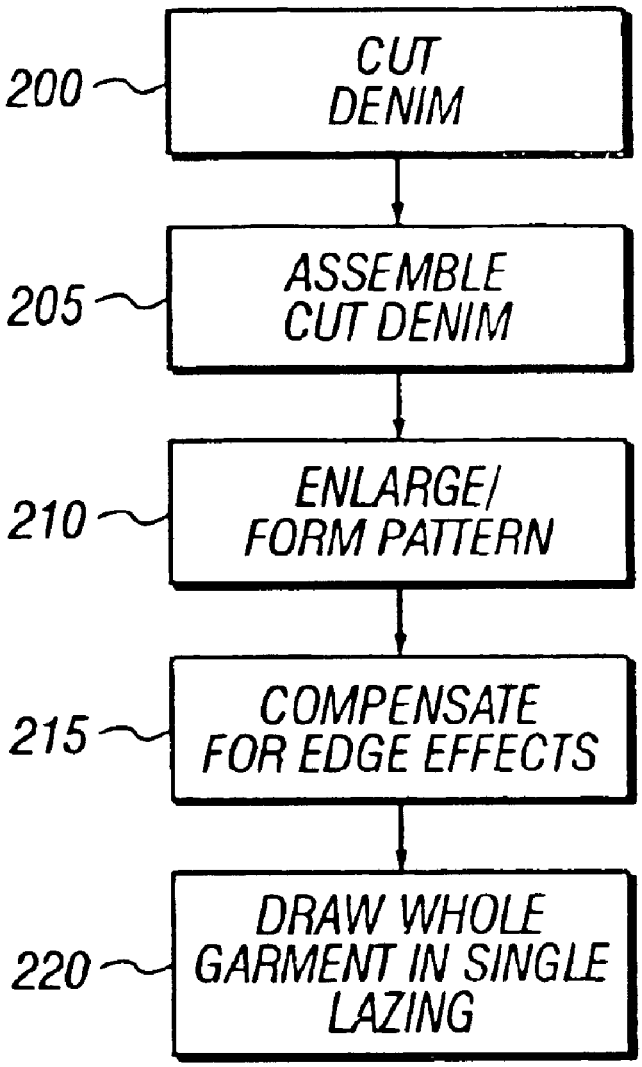
FIG. 2 shows a flowchart of operation.

Hence, the fractal jean production concept would include the operations shown in the flowchart of FIG. 2. At 200, the denim is cut from a denim textile roll to form the cut parts 122, 124. All the denim panels that make up a pair of low rise women's jeans are collected and located in an area, e.g., a 60 inch square area at 205. Other jean cuts such as men's boot cut may require field sizes larger than 60 inch square. The cutting may be optional if the pattern is continuous.

Figure 3:
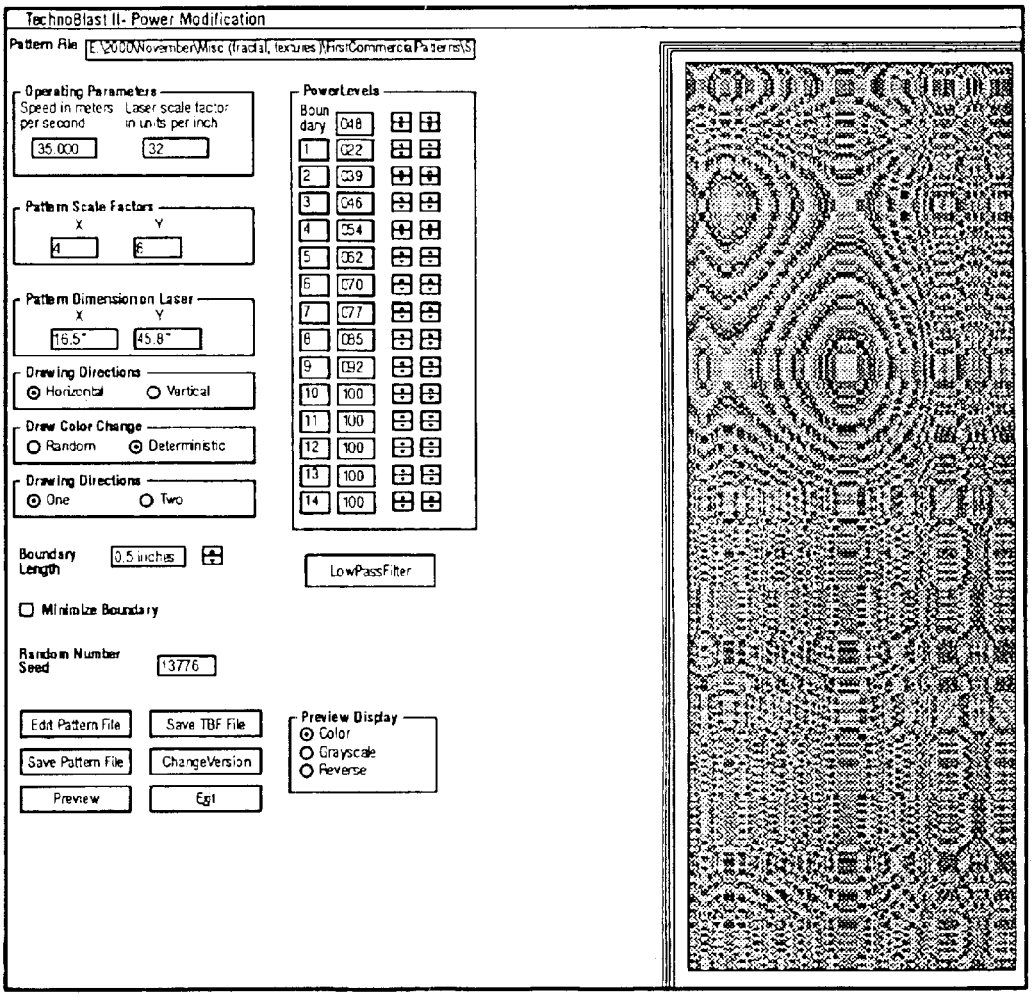
FIGS. 3–7 show specific fractal designs which may be used with this system, including "Swirl"(FIG. 3), "Galaxy" (FIG 4), "Teardrop"(FIG. 5), "Stardust"(FIG. 6) and "Matrix"(FIG. 7).
Figure 4:
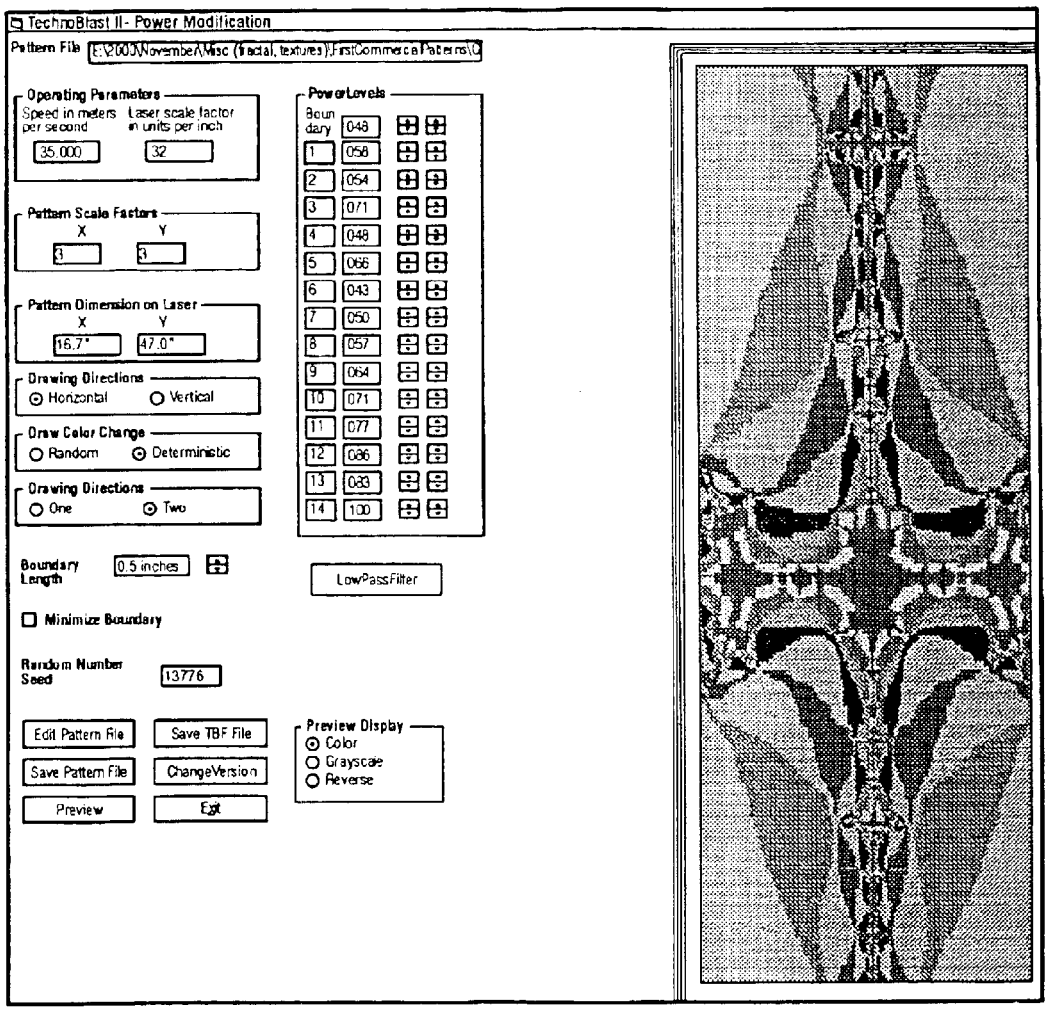
Figure 5:
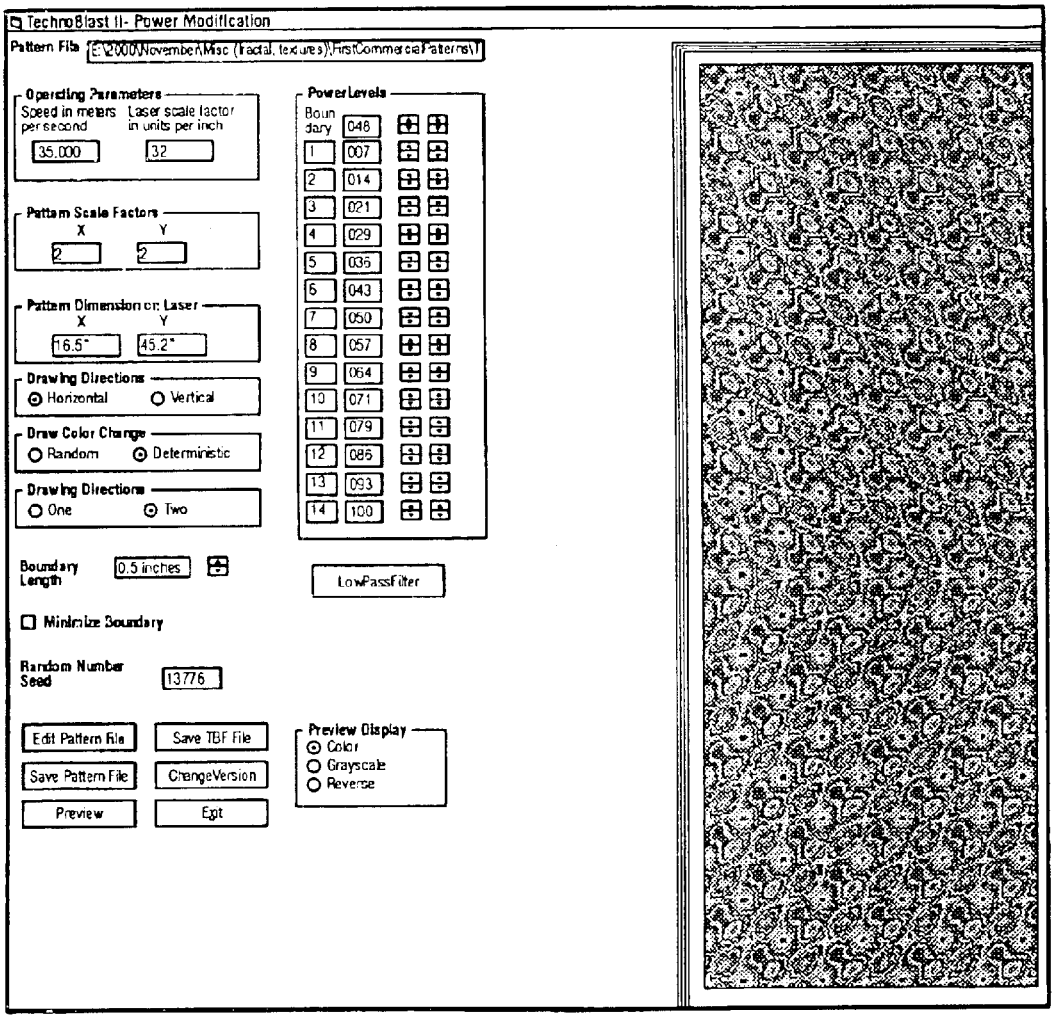
Figure 6:
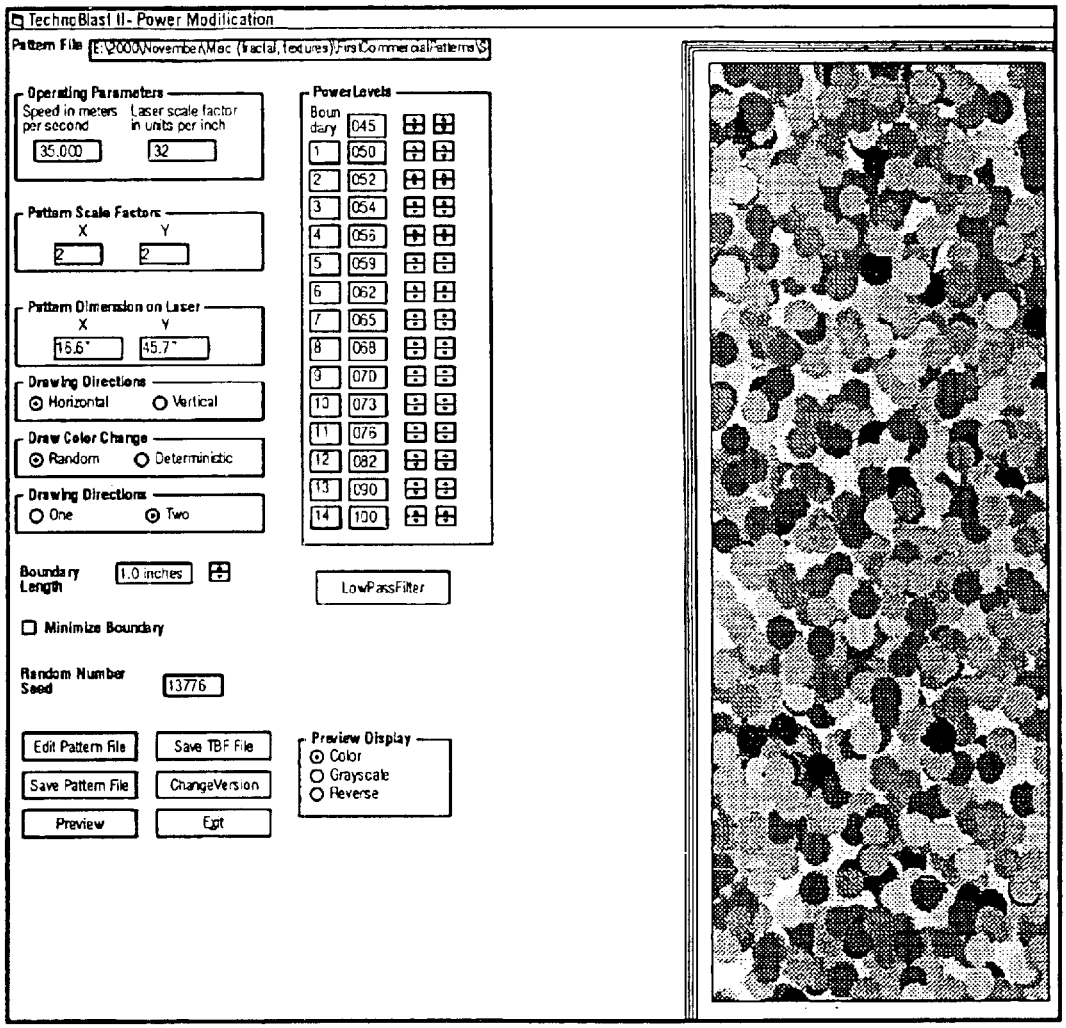
Figure 7:
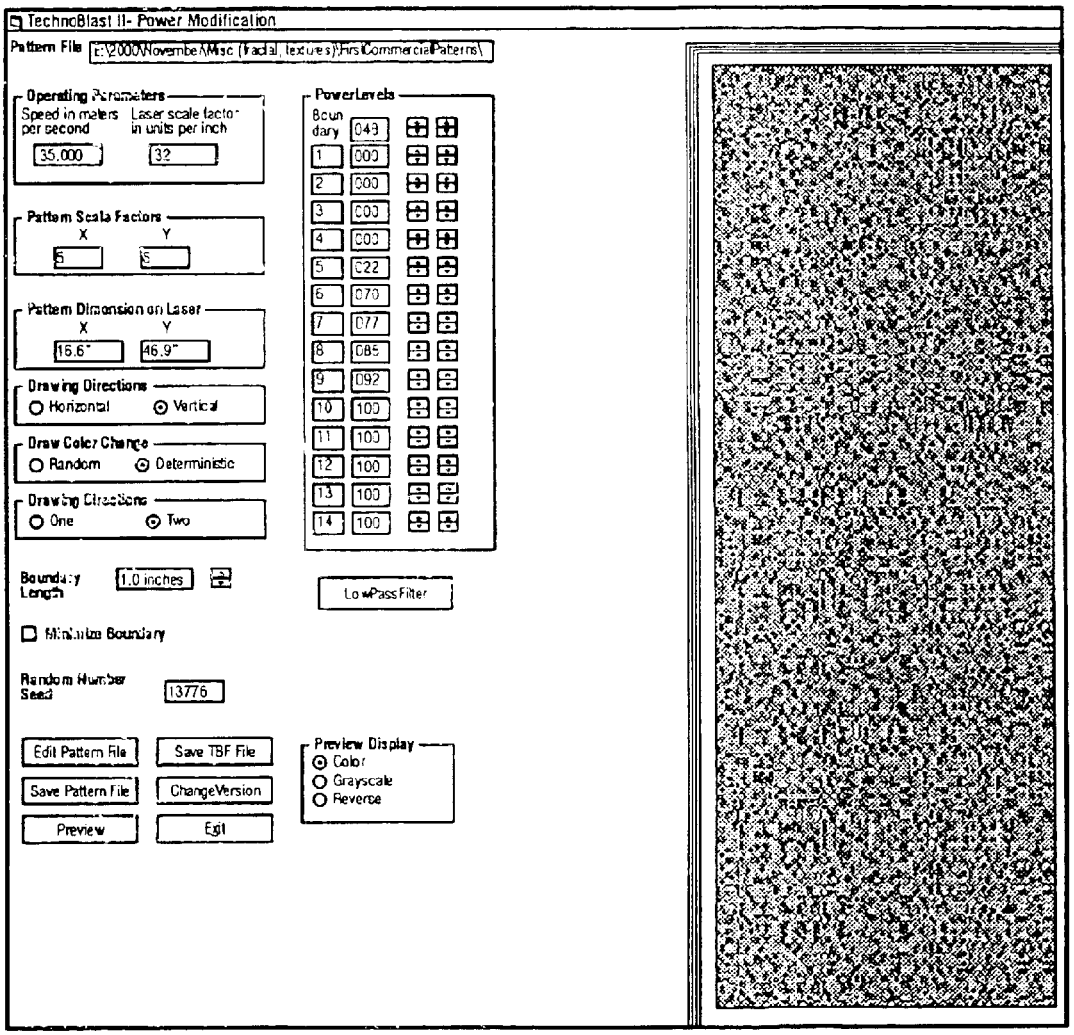

Five distinct graphic designs are described as examples that may be placed on the leg panels in the first production of fractal jeans. The designs are called "Swirl"(FIG. 3), "Galaxy"(FIG. 4), "Teardrop"(FIG. 5), "Stardust"(FIG. 6) and "Matrix"(FIG. 7). Each figure also shows the parameters used to obtain the pattern, using the user interface and techniques in our copending application for fractal jeans Ser. No. 09/730,497. Each fractal also has its own unique design and therefore, the placement of the panels may be crucial during production. Every panel must be facing the right direction and be in the exact location every time for sewing purposes. Designs such as "Swirl" and "Galaxy" must have portions of the design which are centered perfectly on the leg panels. These patterns are not repeatable and the critical part of the design occurs along the middle. Therefore, for satisfactory results, each pattern should lie in the center of each leg panel. More generally, however, any pattern which may be defined according to a mathematical equation, and more preferably according to a fractal function, may be formed using the techniques of the present application.

Each fractal pattern is enlarged to a 60"×60" area at 210. This can be achieved using any imaging technique. Prior to enlarging the image, it is essential to choose the proper power profiles in order to achieve grayscale-like images. Power profiles are assigned to each color. Therefore, by changing the "colors", a totally different design is obtained. Once the powers are set, the image may be expanded while keeping the scale factors constant. This keeps the pixels the same size and prevents the pixel enlargement from distorting the image. Instead, the columns may be enlarged to their maximum size of 2000 pixels.

The next operation includes taking the image; at whatever size it may be scaled, and cutting and pasting the image until the columns are completely filled.

Another method of enlarging the pattern is by using viewer software. This may be used when the pattern's maximum column size exceeds 2000 pixels. This process may take files in a format that is developed to communicate with the laser controller, and combine them into a single file. This may be done, for example, by using some kind of drawing package, e.g., Adobe Photoshop, to view the files as multiple layers that are viewed over one another.

The different layers are maintained as separate files, and the laser separates the two files before lazing. The laser draws the first pattern, and then draws the second pattern.

In operation, the image is created in a 30"×30" area. This simplifies the process when combining the files. In combining the files, the sides must perfectly match up together. Without this operation, the two files will not properly connect.

The files may also be modified to maintain a low boundary power for each file. The lowered boundary may slowly ramp on the power so as to prevent the effects of the start up process of the laser. The low boundary power keeps the patterns from visibly overlapping when combined together. This operation is shown as 215, which is entitled as "edge effects" in the flowchart.

An additional technique may use the actual software on the laser. It is similar to using the previous process. Once again, the software is used to create the pattern of 30"×30". The file is opened. Then, a new part is added to the current job. Both files will appear on the screen. The last step is to line the files up side by side until they connect.

After one of these, or some other, process has been used to enlarge the image 60"×60", and the graphic pattern is then lazed on the denim panels in a single lazing operation at 220.

Every pattern used for production may need to be created using trial and errorr. For example, the "Matrix"design was created by using TechnoBlast software and simply cutting and pasting the image until it fills the proper area. In order for operation to laze properly without any defects, the drawing direction is preferably vertical. The "Stardust" design was also created in TechnoBlast. However, to produce each circle the "shotgun"tool was used to configure the size of each circle and the probability of each being drawn. The "Teardrop"design was first drawn 30"×30" in TechnoBlast, then later finished in viewer. The top and bottom of the pattern must up properly along with the left and right side to perfectly connect all sides. The "Galaxy"and "Swirl"designs were created using TechnoBlast. The columns are expanded to 2000 pixels and the patterns are cut and pasted to fill that region. However, since the patterns do not repeat, and the focal point of the design is in the middle, the patterns had to perfectly fit the leg panels and to center the pattern within the legs. Since the rear panels are bigger than the front panels, the size of the patterns had to be changed accordingly. Therefore, the pattern was combined into large sizes for the rear panels and two smaller sizes for the fronts. Also, due to "Swirl's" intricate pattern, it was drawn one way. A typical pattern is normally drawn two ways, left to right and right to left or top to bottom and bottom to top. "Swirl"must be drawn in only one direction to maximize each power change.

All of these exemplary patterns besides "Stardust" are based upon fractal mathematics or mathematic equation sets. Each pattern has its own complex equation that TechnoBlast reads and configurates into a design. By simply changing a few of the coefficients, a new pattern appears. This is just one method for creating fractal and patterned images. Others include, downloading a picture and converting it to grayscale using drawing software or just by drawing the pattern on the screen with drawing software.

Although only a few embodiments have been disclosed in detail above, other embodiments are possible. All such modifications are intended to be encompassed within the following claims.

What is claimed is:

1. A method, comprising:

using a computer to form a pattern on only a part of a total textile roll, the textile roll having a width that is sufficient to enable forming an entire garment from the roll; and using a laser to form said pattern on said roll;

wherein said textile roll has a width of 60 inches or greater; and cutting parts of the garment from the roll prior to forming said pattern.

2. A method, comprising:

defining a pattern which will be formed on a garment;

using a laser to form said pattern on the material which will form said garment in a single pass of the laser across said material;

wherein said using comprises defining a pattern which will be formed across an area of at least 60 inches in width, and forming said pattern on a textile area of at least 60 inches in width; and sewing different separated pieces into a pattern after said forming.

3. A method, comprising:

defining a pattern which will be formed on a garment;

using a laser to form said pattern on material which will form said garment in a single pass of the laser across said material;

wherein said using comprises defining a pattern which will be formed across an area of at least 60 inches in width, and forming said pattern on a textile area of at least 60 inches in width; and wherein said pattern is formed on portions of the material which will not normally be seen after sewing.

4. A method as in claim 3, wherein said portions of the material which will not normally be seen includes at least one of insides of pockets, waistbands, or under belt loops.

5. A method, comprising:

defining a pattern which will be formed on a garment;

using a laser to form said pattern on the material which will form said garment in a single pass of the laser across said material;

wherein said using comprises defining a pattern which will be formed across an area of at least 60 inches in width, and forming said pattern on a textile area of at least 60 inches in width; and wherein said defining a pattern comprises defining a pattern of a first size, and then expanding said pattern to a second size of said at least 60 inches in width.

6. A method, comprising:

defining a pattern which will be formed on a garment;

using a laser to form said pattern on material which will form said garment in a single pass of the laser across said material;

wherein said using comprises defining a pattern which will be formed across an area of at least 60 inches in width, and forming said pattern on a textile area of at least 60 inches in width; and wherein said defining a pattern comprises defining first and second pattern parts, displaying a resultant of said first and second pattern parts, and wherein said using comprises using said laser to form said first pattern parts and then using said laser to form said second pattern parts at separate times.

7. A method, comprising:

defining a pattern which will be formed on a garment;

using a laser to form said pattern on the material which will form said garment in a single pass of the laser across said material;

wherein said defining a pattern comprises defining boundary powers for said pattern which are reduced at edges of the pattern as compared with power at other positions of the pattern.

8. A method, comprising:

defining a pattern which will be formed on a final garment; and using a laser to form said pattern over an area which is at least 60 inches in width; and wherein said laser is used to form said pattern over all areas of material which will form a final garment, and further comprising sewing said material to form said final garment in a way such that said pattern is formed on at least one portion of the material which will not be normally seen after said sewing.

9. A method as in claim 8, wherein said at least one portion of the material comprises an area inside a pocket.

10. A method as in claim 8, wherein said at least one portion of the material comprises an area inside a waistband.

11. A method as in claim 8, wherein said at least one portion of the material comprises an area under a belt loop.

12. A method, comprising:

defining a pattern which will be formed on a final garment; and using a laser to form said pattern over an area which is at least 60 inches in width; and wherein said using comprises using said laser to form a pattern which applies reduced power at boundary edges as compared with other portions in a pattern.

* * * * *